United States Patent [19]

Klink

[11] 4,083,154

[45] Apr. 11, 1978

[54] MODULAR HOME

[76] Inventor: Leon F. Klink, 78536 Currin Blvd., Cottage Grove, Oreg. 97424

[21] Appl. No.: 787,993

[22] Filed: Apr. 15, 1977

[51] Int. Cl.[2] ..... E04H 1/12

[52] U.S. Cl. ..... 52/79.9

[58] Field of Search ..... 52/79.1, 79.5, 79.7, 52/79.8, 66, 90, 93, 79.9, 639, 643

[56] References Cited

U.S. PATENT DOCUMENTS

| | | | |
|---|---|---|---|
| 1,421,299 | 6/1922 | Palen | 52/93 |
| 3,348,344 | 10/1967 | Tatevossian | 52/90 |
| 3,605,355 | 9/1971 | Solesbee | 52/90 |
| 3,791,082 | 2/1974 | Bowling | 52/90 |

FOREIGN PATENT DOCUMENTS

| | | | |
|---|---|---|---|
| 488,666 | 12/1952 | Canada | 52/90 |

*Primary Examiner*—John E. Murtagh
*Attorney, Agent, or Firm*—Victor J. Evans & Co.

[57] ABSTRACT

Disclosed herein is a modular home which can be preferably comprised of sections which are transported to the building site as structural units and then fastened together to provide a unitary building structure. Specifically detailed herein are the structural features which provide retention of these individual units at the upper portion of the building.

7 Claims, 14 Drawing Figures

FIG. 3.
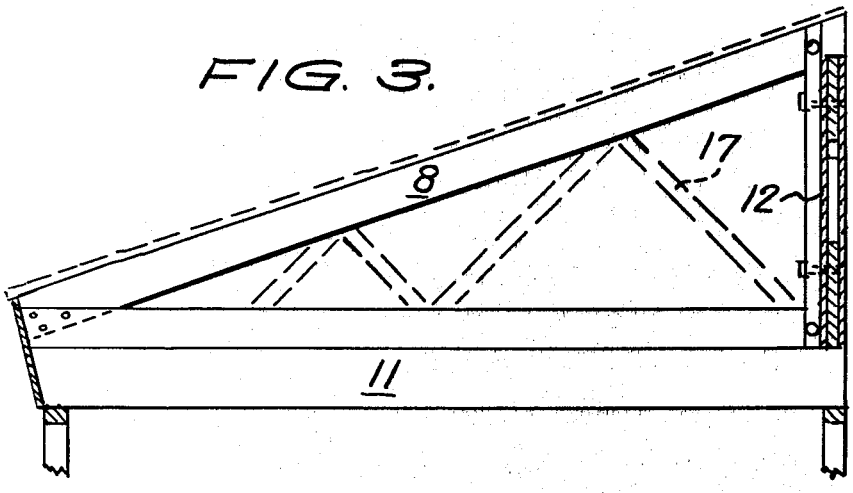
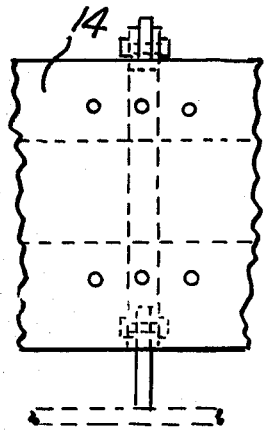
FIG. 4.
FIG. 5.
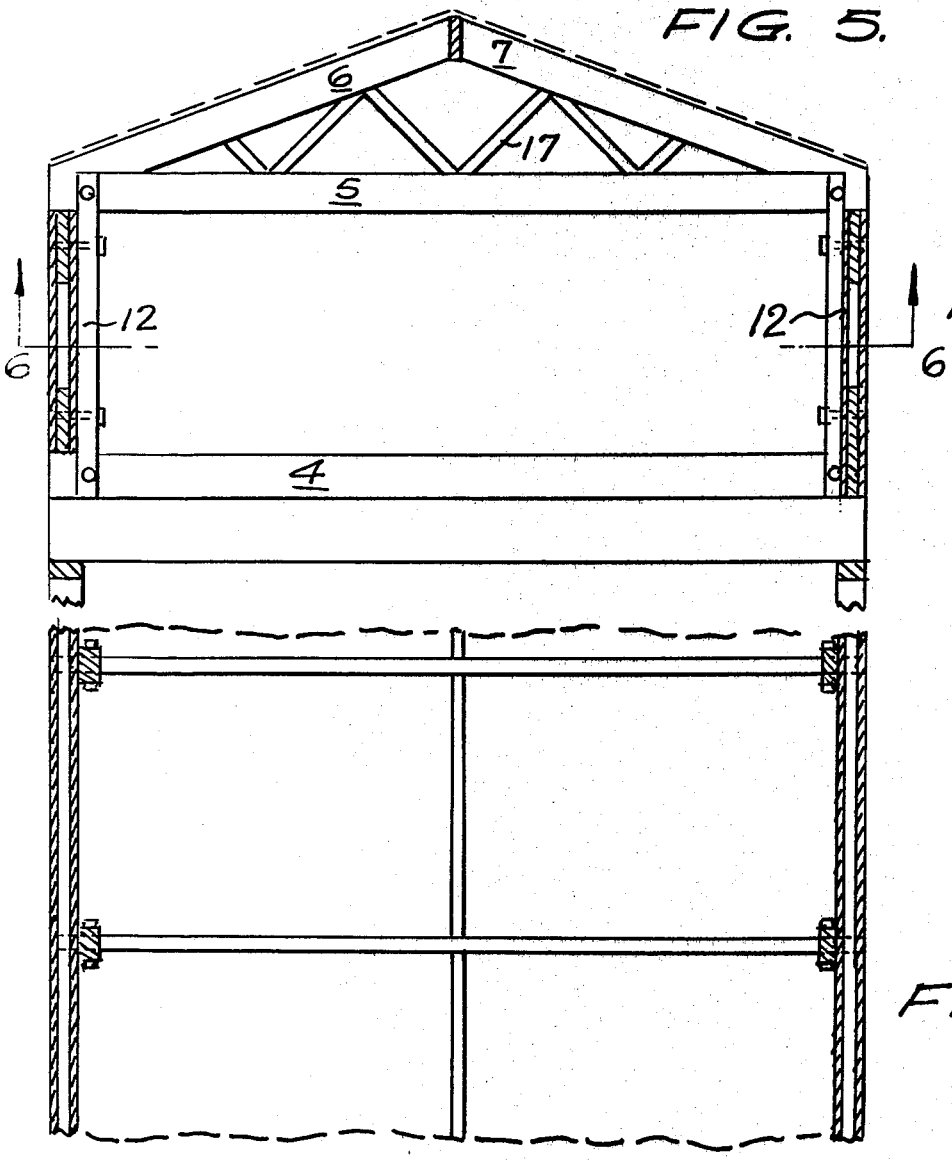
FIG. 7.
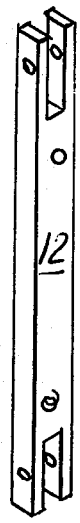
FIG. 6.

13
14
15
16

FIG. 9.
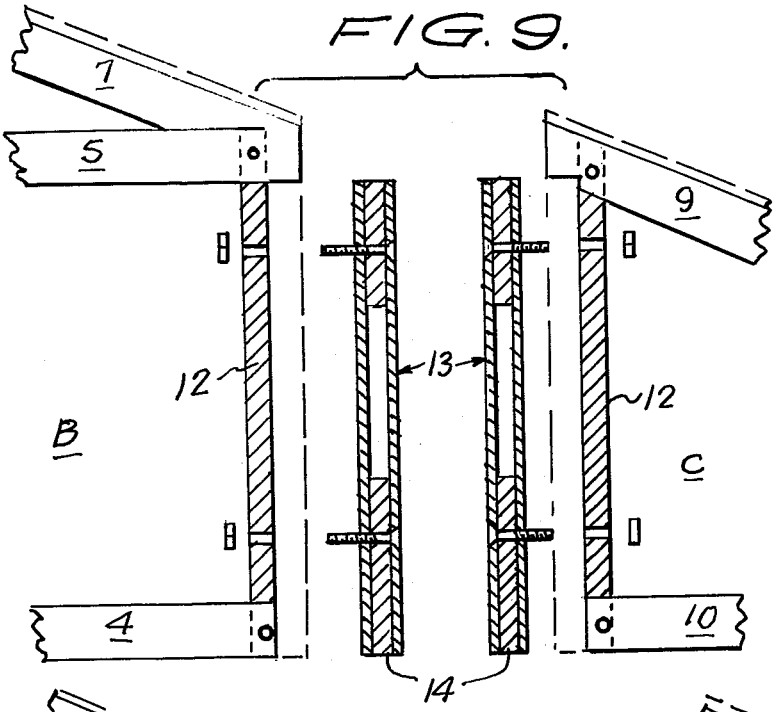
FIG. 12.
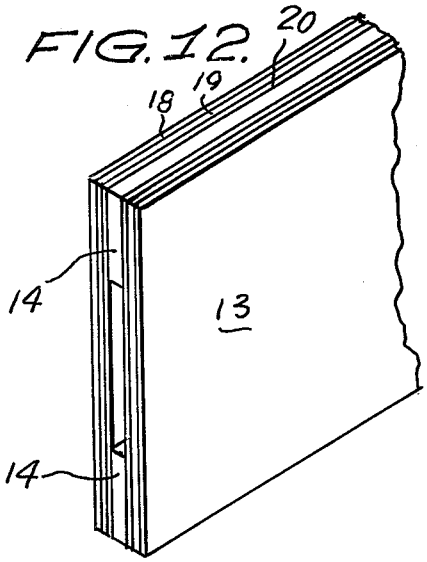
FIG. 11.
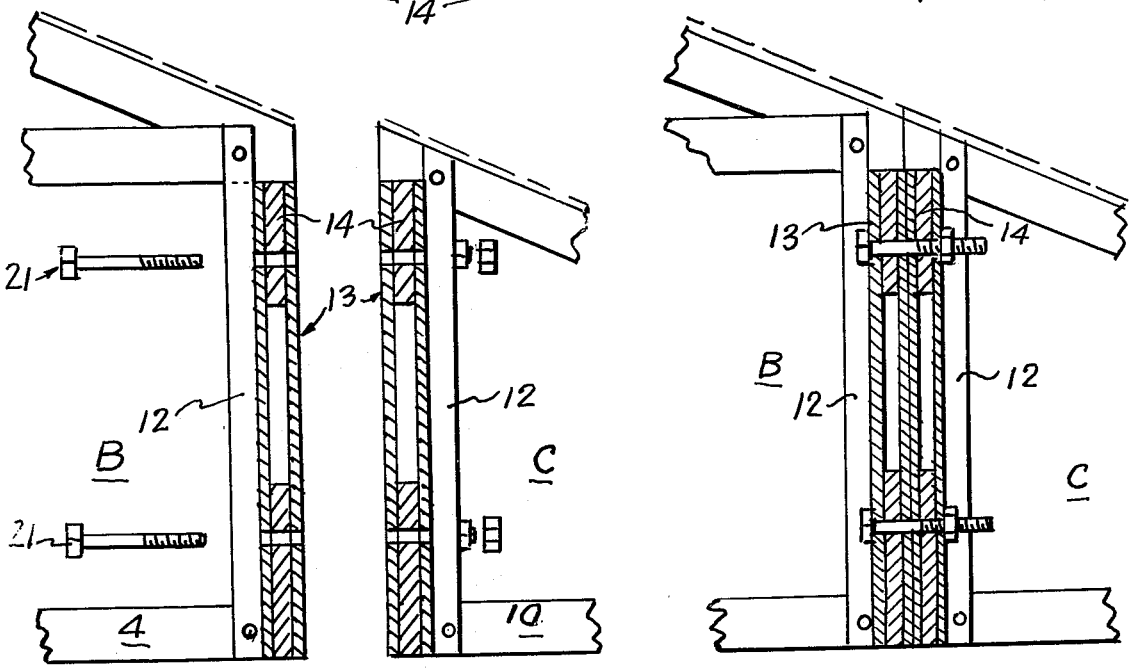
FIG. 10

MODULAR HOME

BACKGROUND OF THE INVENTION

Field of the Invention

The concept of fabricating components for a building structure on a site remote from the actual final building location is known in the art. Attempts in this direction can be characterized in that building sections of substantially similar configuration be fabricated at a plant and be bolted together on the job site.

Accordingly it is an object of this invention to provide a prefabricated building system having three elements, two of which are similar. By appropriately orienting and joining together the three building elements, the final configuration of the building approximates a contour suggestive of a building which has been custom built on the site without prior prefabrication.

It is a further object of this invention to provide a building structure comprised of mobile elements which have improved structural stability while using fewer materials in a manner in which provides additional strength.

These and other objects of this invention will be made manifest when considering the appended drawings and the specification.

BRIEF DESCRIPTION OF THE DRAWINGS

FIG. 3 shows the structural details of the roof member common to both the left and right hand elements of the modular structure;

FIG. 4 shows a detailed view of the structural elements of the right hand portion of FIG. 3;

FIG. 5 shows the detail of the middle element denoted by B in FIG. 2; and focus in primarily on the upper portion or roof section of element B;

FIG. 6 is a view of FIG. 5 taken along lines 6—6 of FIG. 5;

FIG. 7 shows a structural element found in FIGS. 3, 4 and 5;

FIG. 9 shows an exploded parts view of the joining details of sections B and C seen in FIG. 2 and FIG. 1;

FIG. 10 shows a partially assembled view of the exploded parts view of FIG. 9;

FIG. 11 shows an assembled detailed sketch of the parts delineated in FIGS. 9 and 10;

FIG. 12 shows the details of a structural element similar to FIG. 8;

DESCRIPTION OF THE PREFERRED EMBODIMENT

Figure 1:
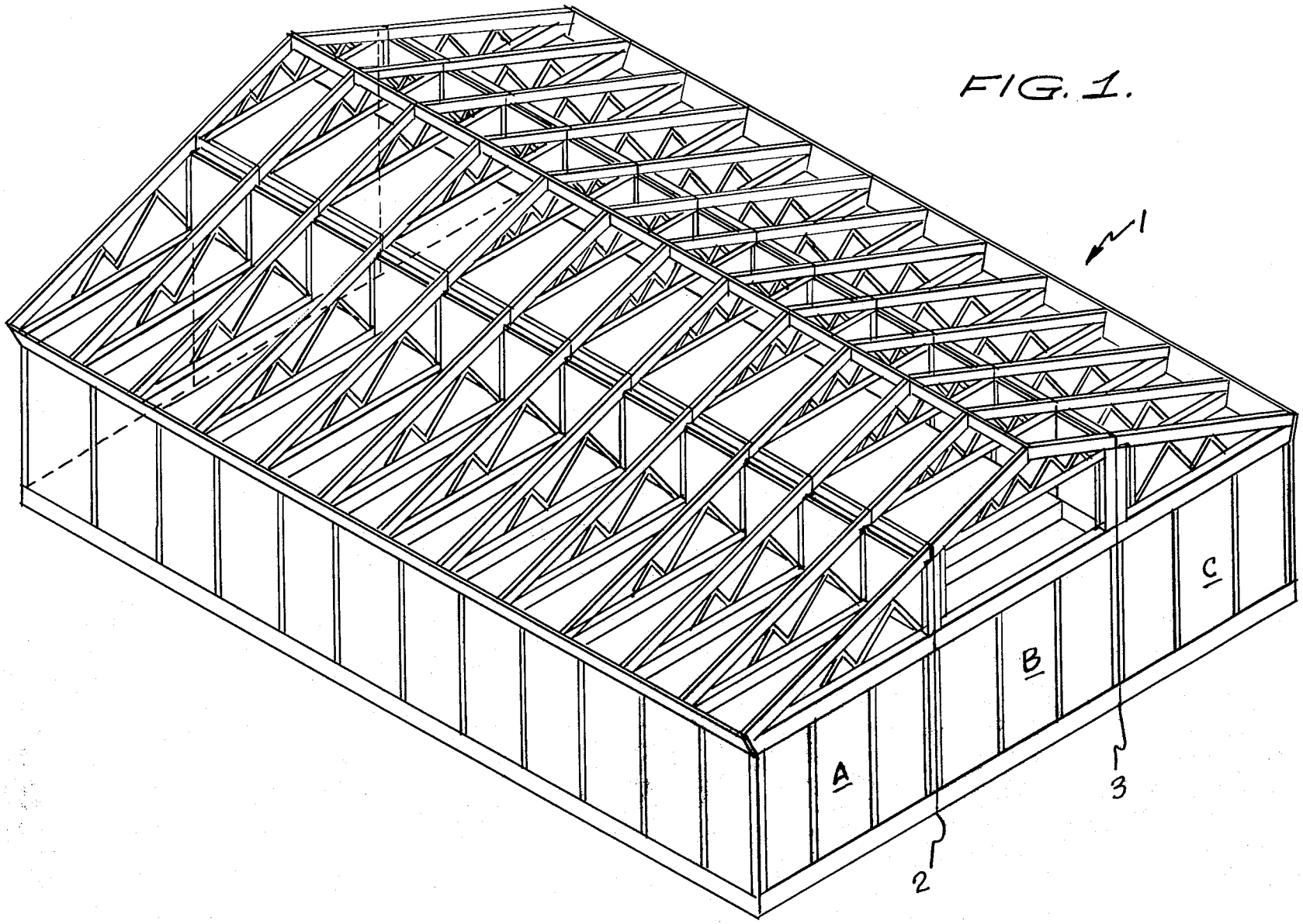
FIG. 1 shows a three quarter depiction of the three structural elements of this invention in its assembled configuration.
Figure 2:
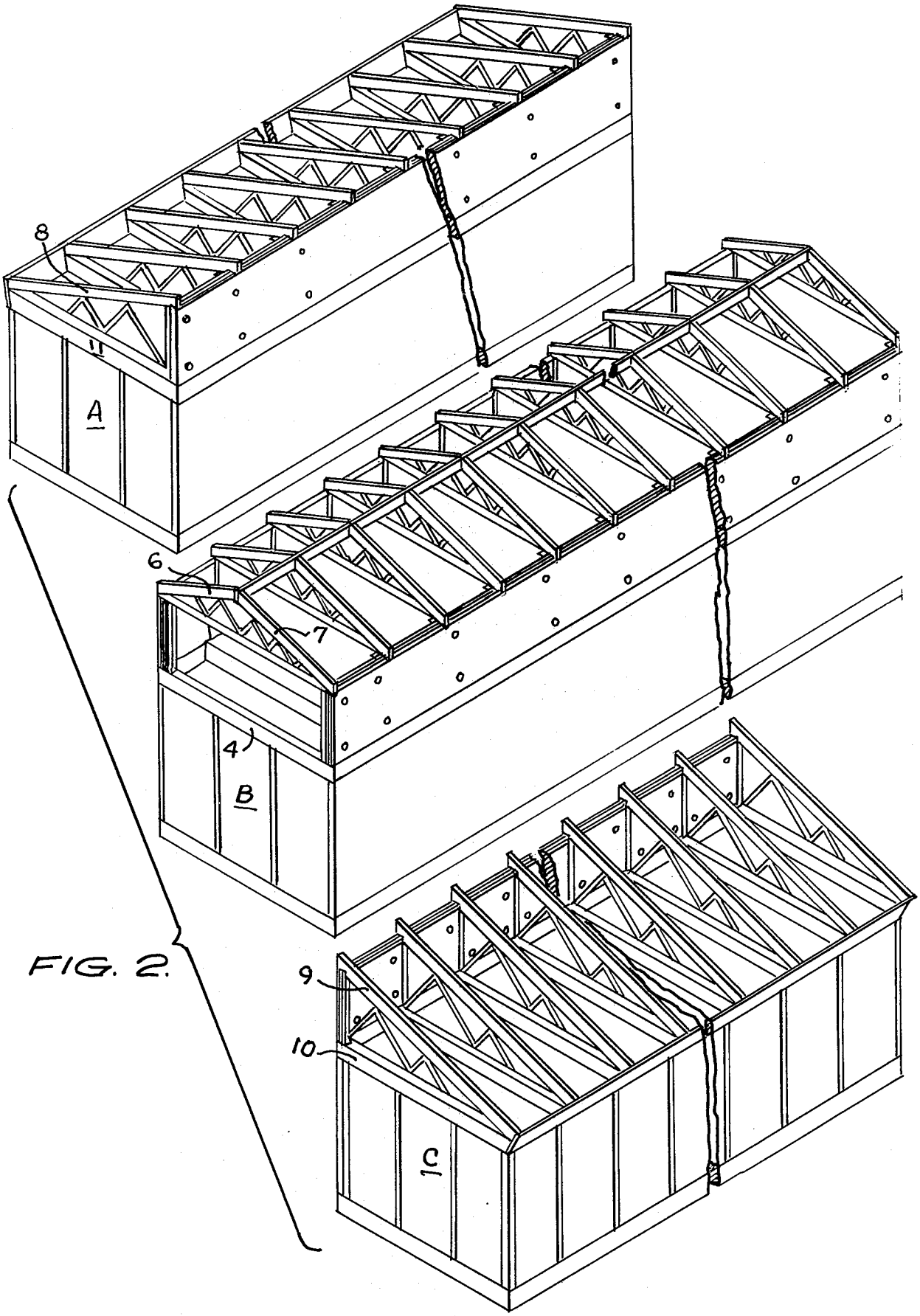
FIG. 2 shows a three quarter view of the three elements of this invention in their detached representative forms.
Figure 14:
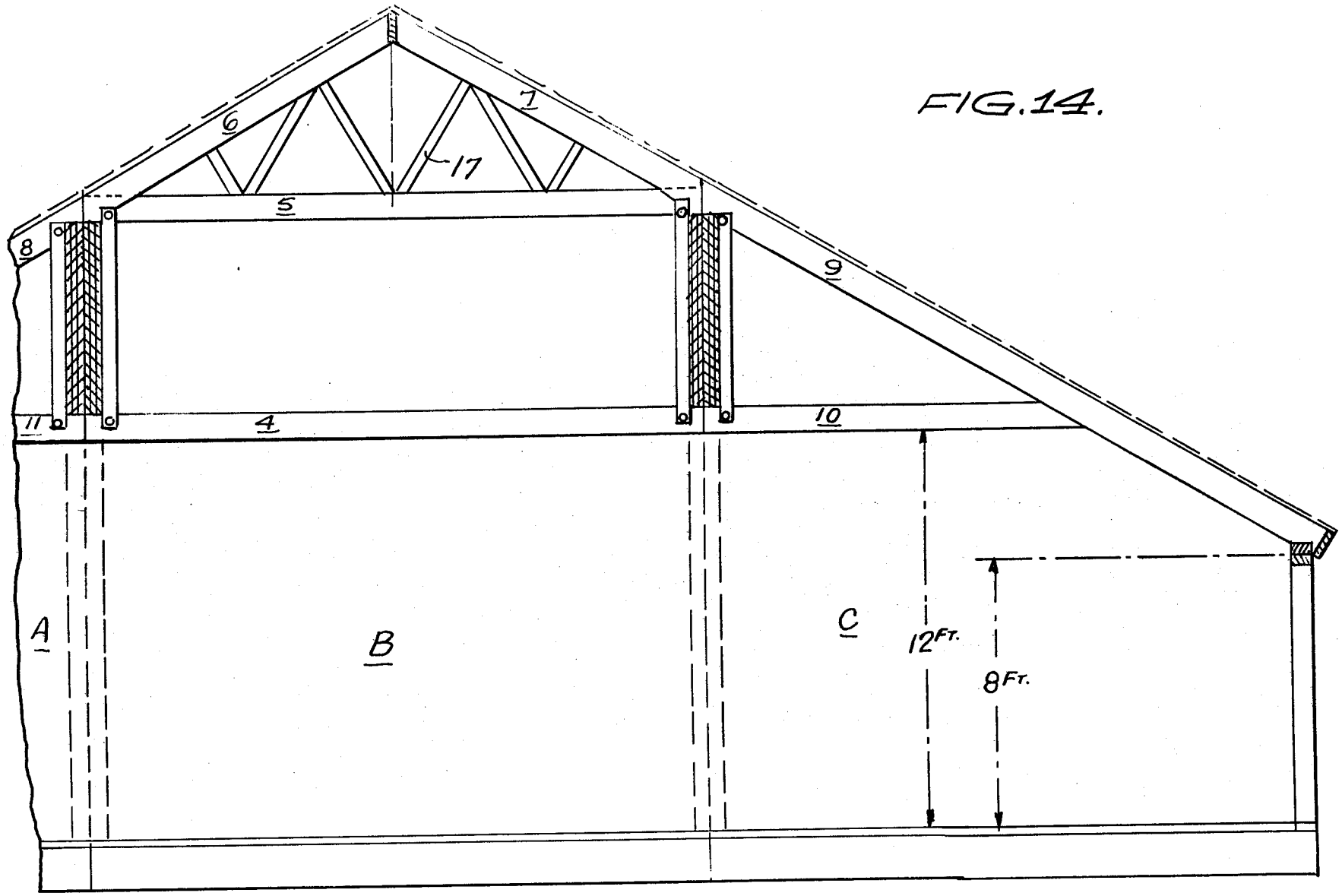
FIG. 14 shows an end view of the modular unit in its unassembled configuration.

Referring to the drawings now wherein like numerals refer to like parts throughout the several drawings, attention is directed first to FIGS. 1, 2 and 14 which show the essence of the invention in an overview.

The three elements of the house are generally denoted as elements A, B and C, and it is to be noted that elements A and C expect for their orientation are identical.

Section B can generally be described as a rectangular building having a triangular top portion which is defined by rafters 6 and 7 having a bottom base member of the triangle defined by joist 5. This triangular section also seen in FIG. 5 is separated and reinforced in its inner triangular area by diagonal cross members and braces 17. Remote from joist 5 and parallel thereto is a lower joist member 4 and the upper joist 5 is separated from the lower joist 4 by means of joist separating member 12 which is a generally H-shaped configuration. Further the separation is reinforced by joist plate 13 which is a laminate which will be described later. The area below lower joist 4 is of conventional rectangular configuration.

The outer elements denoted by A and C of these figures is of generally trapezoidal configuration. Section A and C have a vertical extent at its highest extremity nearest to section B equal to upper joist member 5. Rafters 6 and 7 of section B continue their outward extent by virtue of complementary formed rafters 8 and 9 of sections A and C respectively which terminate at the outer extent of the building and slope downwardly out. Joist members 11 and 10 of sections A and C rexpectively form the bottom leg of a triangle in each of these sections which is enclosed on its third face by the H-shaped joist support 12 which was discussed in relation to section B. Additional support is derived from joist plates 13 located on the inner faces of sections A and C relative to section B. These joist reinforcing bar 12 and provide the means for joining the upper portions of sections A, B and C as will be explained shortly.

Figures 8, 13:
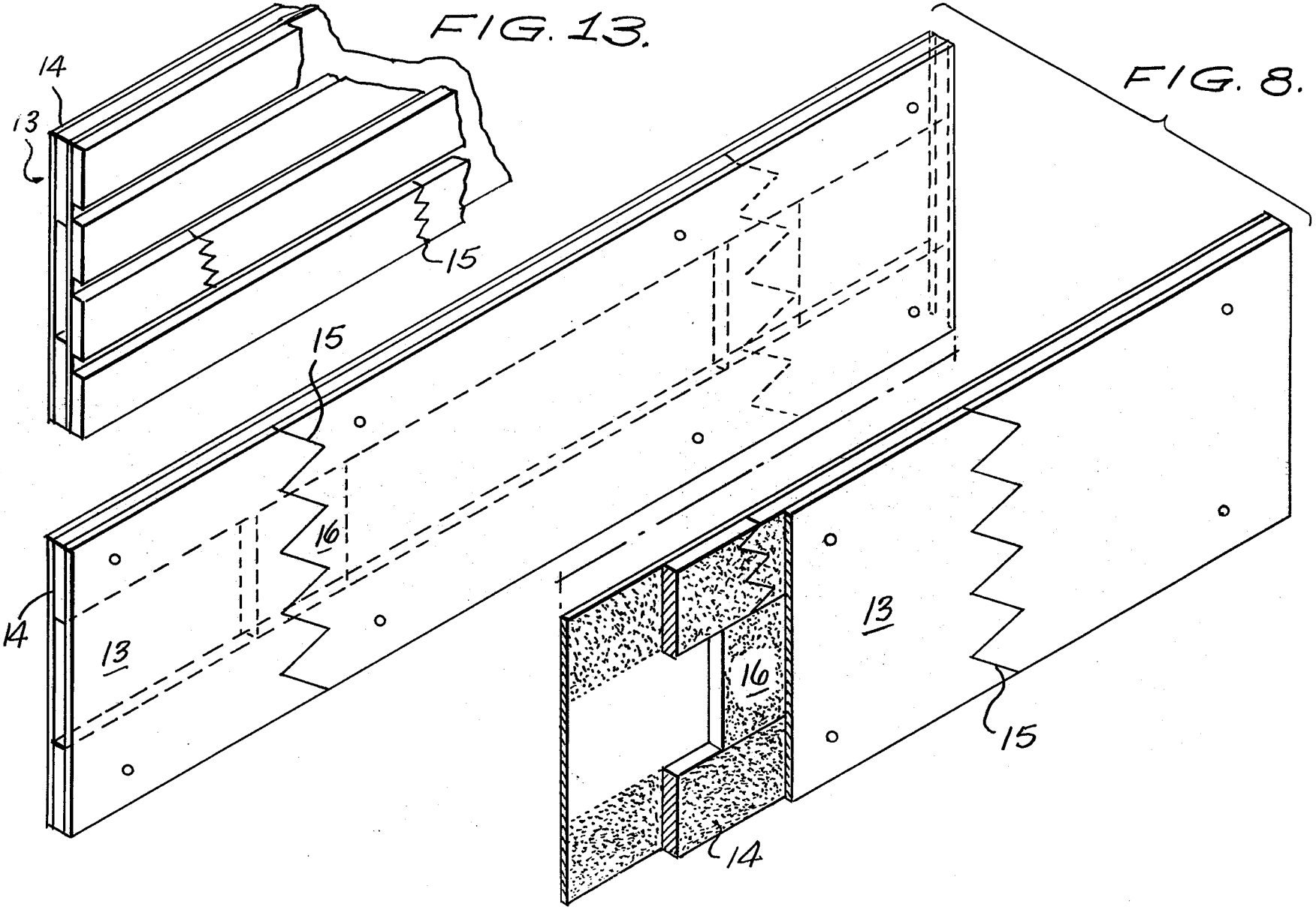
FIG. 8 shows the details of another structural element seen in FIGS. 3, 4 and 5.
FIG. 13 shows an alternative embodiment to the structure set forth in FIGS. 8 and 12.

FIGS. 8, 12 and 13 show different aspects and embodiments of the joist plate generally regarded as numeral 13 and can be described as follows: it is generally a laminar structure having air spaces within the laminate to provide lesser weight and greater strength.

As shown in FIG. 12 joist plate 13 is comprised of a plurality of sheets of material. These sheets may be comprised of wood, aluminum or any other building material as is well known in the art, and the outer and inner faces of this joist plate is separated by spacer member 14, or a plurality of spacer members.

FIG. 8 has a configuration pertaining to these joist plates in which the inner and outer walls and spacers, define a generally rectangular hollow section which have rigidifying support members 16 disposed within the core.

FIG. 13 shows an alternative configuration in which one face of the joist plates has horizontally extending grooves thereon.

In addition FIGS. 8 and 13 indicate a fastening means for these joist plates whemn said plates are of inorganic length. Numeral 15 denotes the means for conjunction of two sections of joist plates when the lengths are of such a magnitude as to warrant a sectional brake down. It will be noted in FIG. 13 that the saw tooth type of conjunction is offset and staggered so as to provide less strain to the localized area where the saw tooth arrangement is continuous on a joist plate. In FIG. 8 there is shown another configuration for staggering the saw tooth arrangement to provide greater support and strength.

FIGS. 9, 10 and 11 show the details in which these sections are joined together at the upper most extremities. There it is found that H-shaped bar member is used to separate for section B the upper and lower joists 5 and 4, and for section C the rafter from the joist 9 from 10. Also detailed thereon are provisions for the joists plate 13 to be assembled in face to face relationship, and FIG. 10 shows the joist plates when placed in tangential relation to the H-shaped bars. FIG. 11 shows the configuration when bolts 21 are used to fasten together sections B and C as an illustrative example through H-shaped bar members 12 and joist plates 13.

The joist plates may take the configuration as shown in FIGS. 8, 12 or 13, and it will be appreciated that the fastening means for the section A to B is similar to the fastening means for sections B to C as described above.

Further it will be appreciated that various building materials such as wood, aluminum, metal etc. or synthetic plastic can be used interchangeably to provide the most economical and structurally sound configuration possible for a given design criteria.

Having thus described the preferred embodiment of the invention it should be understood that numerous structural modifications and adaptations may be resorted to without departing from the spirit of the invention.

What is claimed is:

1. A mobile modular building structure comprising three elements, a center element, and two identical end elements disposed at the extremity of said center element, said center element having a substantially rectangular bottom portion and triangular top portion, said top portion being comprised of a pair of rafters and their joists, said rafters and joists being separated by diagonal brace members, said joist member being separated from a lower joist member by a pair of H-shaped joist bar separators disposed at the extremities of the upper and lower joists, said end elements having rafters which extend outwardly in a smooth continuous extension of said rafters of said middle element, said end elements further having joists which extend outwardly in a smooth continuous contour from said lower joist of said middle element terminating at a point in said rafter, and an H-shaped joist bar connecting said rafter of said end element with said joist of said end element in registry with said H-shaped joist bar of said middle element.

2. The structure of claim 1 further including a pair of joist plates disposed between the H-shaped joist bar of the middle section and the H-shaped joist bar of the end section.

3. The device of claim 2 in which said joist plates are comprised of laminates having a substantially hollow core.

4. The device of claim 3 in which said hollow joist plates have portions within the core to provide structural support for the hollow member.

5. The device of claim 3 in which one face of said joist plate has horizontal grooves disposed thereon.

6. The device of claim 4 in which the faces of said rectangular joist plates are comprised of a series of elements fastened along its length by a saw tooth bond.

7. The device of claim 6 in which the saw tooth bonds are staggered along the length of the beam.

* * * * *